United States Patent [19]

Grant

[11] Patent Number: 4,610,608

[45] Date of Patent: Sep. 9, 1986

[54] AIR PUMP CONSTRUCTION

[75] Inventor: Benton H. Grant, Stamford, Conn.

[73] Assignee: Grant Airmass Corporation, Stamford, Conn.

[21] Appl. No.: 412,287

[22] Filed: Aug. 27, 1982

[51] Int. Cl.[4] ..... F04B 45/04

[52] U.S. Cl. ..... 417/413

[58] Field of Search ..... 417/413, 416, 419, 472

[56] References Cited

U.S. PATENT DOCUMENTS

| | | | |
|---|---|---|---|
| 3,669,573 | 6/1972 | Levensohn | 417/416 |
| 3,825,374 | 7/1974 | Kondo | 417/413 |
| 4,154,559 | 5/1979 | Enomoto | 417/413 |

*Primary Examiner*—Cornelius J. Husar
*Assistant Examiner*—Peter M. Cuomo
*Attorney, Agent, or Firm*—St. Onge Steward Johnston & Reens

[57] ABSTRACT

Disclosed is an electric air pump assembly and a subassembly for use therein which speeds assembly and assures proper alignment of the operative pump parts to facilitate proper pump operation while minimizing fatigue failures due to misalignment.

The electric air pump assembly (10) is of the type comprising a housing (20) enclosing at least one diaphragm pump (30) having a base (31) and a reciprocable diaphragm (32), an actuator arm (40) affixed to the diaphragm at a location between the two ends of the arm, pivot means (61) for supporting one end (43) of the arm, and electromagnet means (50) operable to reciprocate the unsupported end (41) of the arm and thereby cause the arm to reciprocate about the pivot means and effect reciprocating movement of the diaphragm which in turn creates an air flow from the pump. Alignment means (60) are provided for aligning the actuator arm and the diaphragm within the housing, the alignment means being attachable to the housing and being integral with both the diaphragm pump base and the pivot means.

13 Claims, 5 Drawing Figures

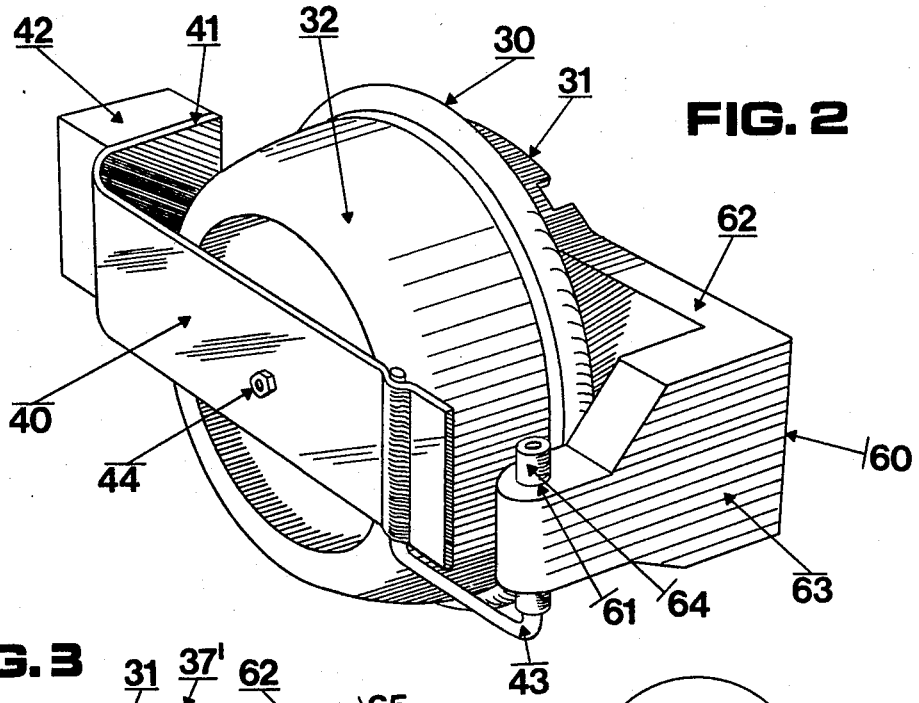
FIG. 2
FIG. 3
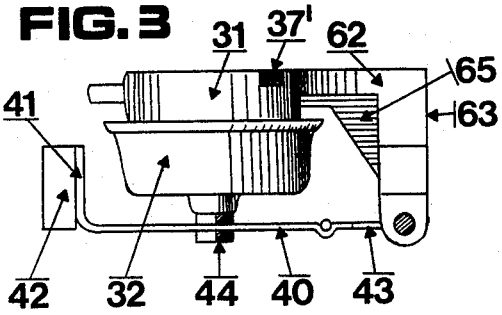
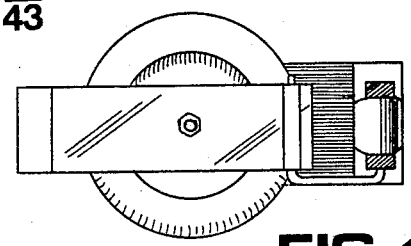
FIG. 4
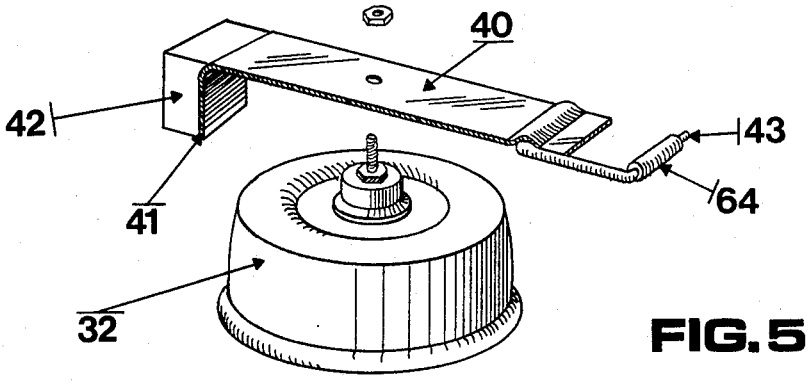
FIG. 5
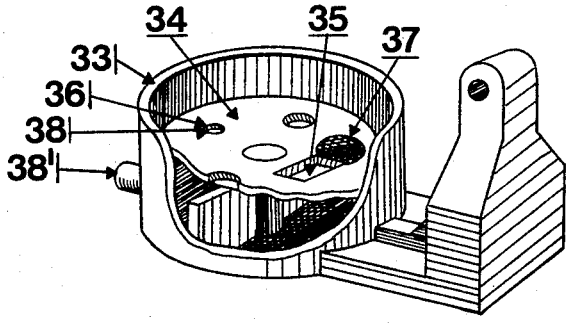

AIR PUMP CONSTRUCTION

TECHNICAL FIELD

This invention relates to air pumps; and, particularly to improvements in electric air pumps of the type having a housing enclosing a diaphragm pump comprising a base and a diaphragm, an actuator arm affixed to the diaphragm, pivot means for supporting one end of the arm, and electromagnet means for reciprocating the other end of the arm to move the diaphragm and effect air flow.

Pumps of this type have been in use for years and are generally reliable. They are advantageous for a number of uses requiring a source of low pressure air, such as supplying air to aquariums and inflating air mattresses.

When breakdowns have occured in the past, they have, in the majority of cases been due to failure of the diaphragm or the actuator arm. The relative value of these parts is minimal compared to the overall cost of the pump and there is great economic incentive to repair the pumps instead of replacing them. Unfortunately, repair of prior art pumps was difficult and frequently unsuccessful. Often after repair by replacement of the diaphragm or actuator arm, the pump performance would be poor and repeated breakdowns would be more frequent. Because improper alignment was suspected as the cause for the poor performance and frequent breakdowns, the care involved in reassembling the parts of the pump was extremely time-consuming. In addition, the initial assembly time for new pumps was also made more complicated and time-consuming than was desired.

BACKGROUND ART

The prior art device of most particular relevance included a housing enclosing two diaphragm pumps attached to two sidewalls of the housing, two actuator arms secured by a unitary bracket to one end wall of the housing, and an electromagnet secured to the other end wall of the housing to effect reciprocal movement of the actuator arms and diaphragm to which they are attached. Devices of this type were extremely difficult to assemble properly initially and also to reassemble during repair to achieve the degree of reliability and performance that was desired. While the exact cause for the difficulties has not been isolated, it became apparent that a redesign of the device in a way which would control inter-related tolerances and assure proper alignment of the various parts with a simplified assembly procedure was required.

Among the sources of alignment difficulties with the prior art device was that the bracket which pivotally supports the actuator arms had to be positioned at exactly the right height in relationship to both of the diaphragm pumps and also had to be aligned precisely relative to the plane of movement such that the pivot points for both actuator arms permitted reciprocating motion along the line which presented the least stress to either the actuator arms or the rubber diaphragm. Another source of difficulty in alignment resulted from the normal deviations in size and shape of the component parts, drill holes, gasketing materials, and the like which, even through within commercially practical tolerances, result in cumulative deviations which inherently result in misalignment in a number of devices.

There is a present need for an improved electric air pump assembly of the type described which would be easier to assemble initially and during repair, and which would offer a greater promise of reliability and freedom from failure once assembled.

DISCLOSURE OF INVENTION

In accordance with the present invention, I provide an improved electric air pump assembly and an alignment means adapted for use with it to simplify initial assembly and repair. The air pump assembly is of the type comprising a housing containing at least one diaphragm pump having a base and a reciprocable diaphragm, an actuator arm affixed to the diaphragm at a location between the two ends of the arm, pivot means for supporting one end of the arm, and electromagnet means operable to reciprocate the unsupported end of the arm and thereby cause the arm to reciprocate about the pivot means and effect reciprocating movement of the diaphragm to generate an air flow. The electric air pump assembly is improved according to the present invention by the provision of alignment means for aligning the actuator arm and the diaphragm within the housing, the alignment means being attachable to the housing and being integral with both the diaphragm pump base and the pivot means.

In its more preferred aspects, the alignment means will comprise an integrally-molded bracket which includes a first leg comprising the diaphragm pump base and means for securing it to a housing, and a second leg which positions the pivot means effectively to support an actuator arm in spaced relation to the pump base such that reciprocation of the activator arm will reciprocate the diaphragm. The alignment means can comprise a generally L-shaped bracket which is integrally molded of a thermoplastic material, such as nylon. To minimize wear and facilitate smooth operation, the pivot means preferably holds a resilient bearing material. To assure accurate alignment of the alignment means within the housing over extended periods of time and prevent flow and distortion of the thermoplastic material, the alignment means will preferably have its movement restricted at at least two points.

According to a preferred embodiment, the diaphragm is rubber and sealingly engages the exterior of a cylindrical wall comprised in the vase of the diaphragm pump; and the cylindrical wall encloses a pumping chamber having an input flutter valve operable to permit air to enter but inhibit its exhaust through an input port, and an output flutter valve to permit air to exhaust but inhibit its entrance through an exhaust port.

BRIEF DESCRIPTION OF THE DRAWINGS

The present invention will be better understood and its advantages will become more apparent from the following detailed description, especially when read in light of the accompanying drawings wherein:

FIG. 2 is a perspective view of a preferred alignment means with associated diaphragm pump and actuator arm according to the invention;

FIG. 3 is a top plan view of the sub-assembly shown in FIG. 2;

FIG. 4 is a front elevation view of the sub-assembly shown in FIGS. 2 and 3; and FIG. 5 is a partially-exploded, partially-sectional view illustrating the detail of a preferred diaphragm pump according to the invention.

BEST MODE FOR CARRYING OUT THE INVENTION

Figure 1:
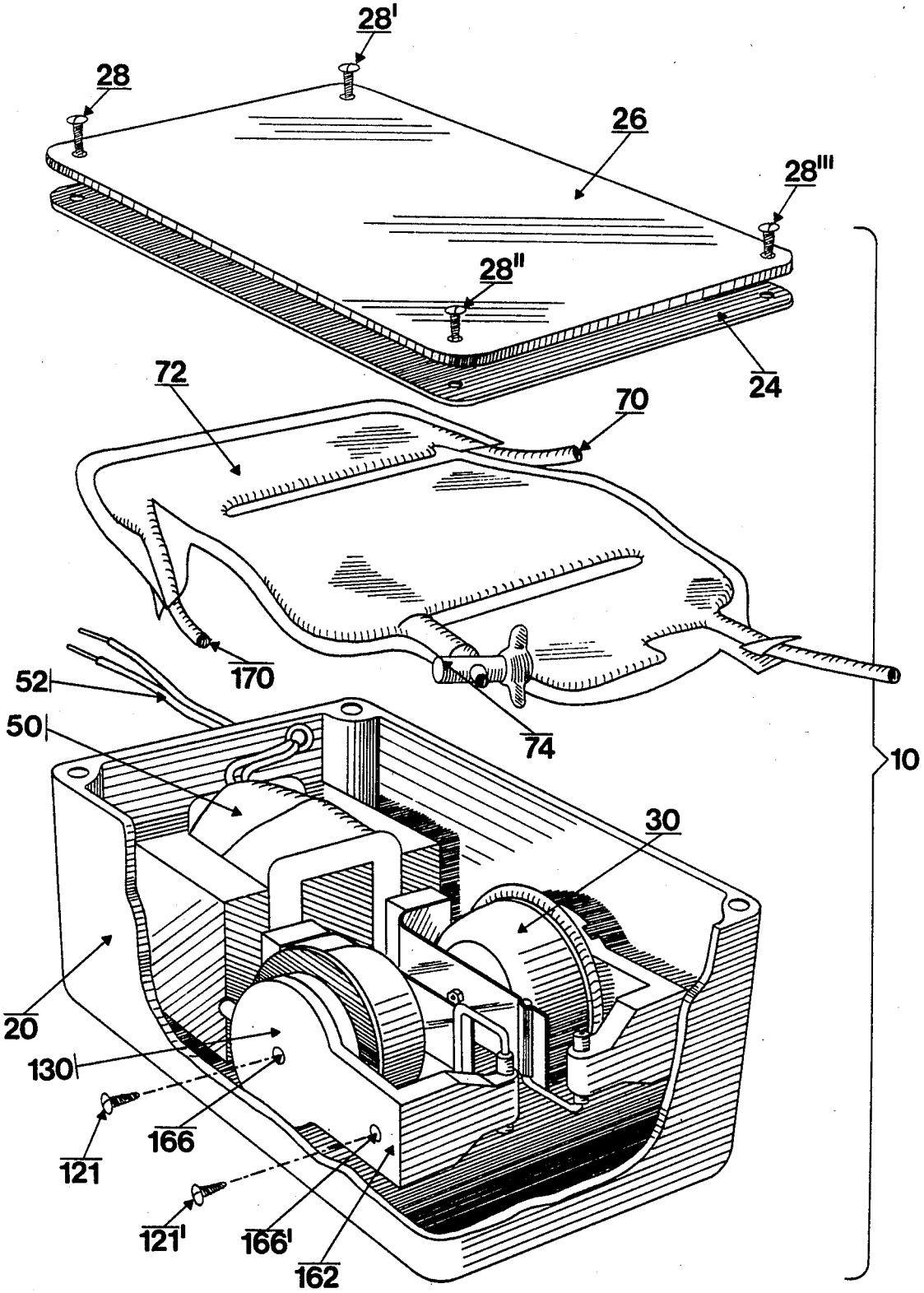
FIG. 1 is a partially-exploded, partially-cut-away perspective view of a preferred electric air pump assembly according to the invention.

Referring now to the partially-exploded, partially-cut- away view in FIG. 1, there is shown a preferred embodiment of an electric air pump assembly shown generally as 10. The air pump assembly comprises a housing 20 containing diaphragm pumps shown generally as 30 and 130. The following description will center upon the arrangement of pump 30 for conciseness in description, with all like parts in pumps 130 and associated directly with it having the same last two digits as those for like parts in pump 30.

Pump 30 includes a base 31 and a reciprocable diaphragm 32. Affixed to the diaphragm 32 is an actuator arm 40 having a free end 41 which preferably comprises a permanent magnet 42, and a pivotally supported end 43. The actuator arm 40 is secured to the diaphragm 32 by means 44 located between the two ends of the arm.

An electromagnet means 50 is operable to reciprocate the unsupported end 41 of the arm 40 to thereby cause the arm to pivotally reciprocate about end 43, effect reciprocating movement of the diaphragm 32, and generate a flow of air from the pump 30.

Assembly of the pump 30 and the actuating arm 40 in the proper alignment with respect to the housing 20 and the electromagnet means 50 is simplified according to the present invention by the provision of alignment means generally shown as 60. The alignment means is attachable to the housing 20 and is integral with both the diaphragm pump base 31 and a pivot means 61 which pivotally supports end 43 of the actuator arm 40.

The alignment means 60 will preferably be integrally molded, such as by injection molding, of a thermoplastic material, such as nylon. As shown in FIG. 3, the alignment means 60 can have legs 62 and 63 arranged as a generally L-shaped bracket. Integral with leg 62 is base 31 of diaphragm pump 30. Integral with leg 63 is pivot means 61 which preferably holds a resilient bearing material 64. The bearing material 64 will preferably be rubber in the form of a sleeve through which the formed wire element 43 which comprises the free end of the actuator arm is positioned. Preferably, triangular reinforcement member 65 is employed to provide added strength and rigidity to promote vibration-free operation and consistency of alignment over an extended life cycle. Other variations of the bracket and alternatives to the wire element 43 are also possible.

Means for restricting the movement of the alignment means relative to the housing are preferably provided. As seen best is FIG. 1, recesses 166 and 166' are provided in the backside of arm 162 to receive screws 121 and 121' which extend through holes (not shown) in housing 20. While it is possible that satisfactory alignment could be maintained through use of a single screw, it is preferable to restrict the movement of the alignment means at at least two points. As an alternative to providing screws at both locations, the housing 20 can be shaped to include an integral lug or other movement-restricting device to cooperate with the alignment means and a single screw to insure alignment. Preferably, a rubber backing or gasket material (not shown) is placed between the housing 20 and the back side of arm 162.

Referring now to FIG. 5, the base 31 of the diaphragm pump 30 is seen to comprise a cylindrical wall 33 which encloses a pumping chamber 34 having an input flutter valve 35 and an output flutter valve 36. The input flutter valve 35 is operable to permit air to enter but inhibit its exhaust through an input port 37. The output flutter valve 36 is operable to permit air to exhaust but inhibit its entrance through exhaust port 38. Preferably, the diaphragm, which is constructed of a resilient material such as rubber, will sealingly engage the outer surface of wall 33. A pump constructed in this manner will draw air into the pump through inlet such as 37' which is in communication with inlet port 37 as actuator arm 40 is moved away from pump face 31, and will exhaust air by a pumping action through means such as 38' which is in communication with exhaust port 38 on the opposite stroke of arm 40 toward the diaphragm pump base 31.

Actuator arm 40 is caused to reciprocally move toward and away from base 31, pivoting about means 61 by the operation of electromagnet means 50. According to the preferred embodiment, a permanent magnet 42, such as a ceramic magnet of the Ceramic-5 permanent magnet type, is affixed to the free end 41 of arm 40. The electromagnet means 50 is caused to provide a magnetic field which cyclically alternates polarity by energizing it with alternating current, such as typical 60 cycle alternating current supplied by a means of power cord 52.

Conduit 70 receives air discharged from outlet 38', and conduit 171 receives air discharged from conduit 138'. Preferably, a pressure stabilization chamber 72 having a suitable device such as bleed valve 74 is provided to limit the maximum pressure for supply by the pump assembly. Other suitable means in place of valve 74, such as a spring and ball mechanism, can be employed. By properly setting the position of valve 74, the output pressure through line 76 can be limited to a predetermined value. This has two significant advantages: first, it provides a measure of safety for the means to which the pump are attached, preventing excessive application of pressure; and second, it prevents overstressing of the internal pump parts when air flow is excessively restricted at some point in line 76 or downstream thereof.

Referring again to FIG. 1, it can be seen that the air pressure regulator 70 is positioned directly over the electromagnet means 50, the two diaphragm pumps 30 and 130, and the associated other parts which are located within housing 20. While not shown in the drawing, it is preferred to employ a spacer member between means 70 and the parts of the air pump assembly which are located below it within the housing 20. Preferably this spacer material will be a strip of a material such as fish paper. Rubber gasket 24 is placed over means 70 and the housing is preferably closed by a cover 26 secured by screws 28, 28', 28'' and 28'''.

The electric air pump assembly according to the invention has the advantage that assembly initially is simplified due to the prealignment of the diaphragm pump base 31, diaphram 32, pivot means 61 and actuator arm 40 prior to placement within the housing 20. Accordingly, placement within the housing is simply a matter of securing it by means of screws such as 166 and 166', there being no need to further adjust or align the operative parts. This advantage which permits easy initial assembly, also simplifies repair to the extent that it is economical and practical to repair pumps of this type with a high degree of assurance of proper performance and freedom from further premature breakdown.

The above description is for the purpose of teaching the person skilled in the art how to make and use the invention. The description is not meant to describe in detail each and every obvious modification and variation of the invention which will become apparent to the skilled worker upon reading the description. It is intended, however, to include all such modifications and variations within the scope of the invention which is defined by the following claims.

I claim:

1. An electric air pump assembly of the type comprising a housing containing at least one diaphragm pump having a base and a reciprocable diaphragm, an actuator arm affixed to said diaphragm at a location between the two ends of said arm, pivot means for supporting one end of said arm, and electromagnet means operable to reciprocate the unsupported end of said arm and thereby cause said arm to reciprocate about said pivot means and cause said diaphragm to reciprocate in a pumping action, which further comprises: alignment means, integrally formed in one piece with said diaphragm pump base and said pivot means, for aligning said actuator arm and said diaphragm within said housing, said alignment means being attachable to and removable from said housing independently of said electromagnet means.

2. An electric air pump assembly according to claim 1 wherein said alignment means comprises a generally L-shaped bracket, one leg of which comprises said diaphragm pump base and includes means for securing it to an interior wall of said housing, and the other leg projects inwardly from the interior housing wall and comprises said pivot means.

3. An electric air pump assembly according to claim 1 wherein said alignment means, said diaphragm pump base and said pivot means are integrally molded from a thermoplastic material.

4. An electric air pump assembly according to claim 3 wherein the thermoplastic material comprises nylon.

5. An electric air pump assembly according to claim 2 wherein said pivot means holds a resilient bearing material.

6. An electric air pump assembly according to claim 1 wherein said unsupported end of said arm comprises a permanent magnet.

7. An electric air pump assembly according to claim 1 wherein said diaphragm is rubber and sealingly engages the exterior of a cylindrical wall comprised in said base of said diaphragm pump; said cylindrical wall enclosing a pumping chamber having an input flutter valve operable to permit air to enter but inhibit its exhaust through an input port, and an output flutter valve to permit air to exhaust but inhibit its entrance through an exhaust port.

8. An electric air pump assembly according to claim 1 including at least two means for restricting movement of said alignment means relative to said housing.

9. An electric air pump assembly according to claim 8 wherein at least one of said means for restricting movement comprises a recess adapted to receive a screw that extends through said housing.

10. An electric air pump assembly according to claim 1 which includes two diaphragm pumps, each with associated actuator arms and alignment means.

11. An alignment means adapted for use with an electric air pump assembly of the type comprising a housing containing at least one diaphragm pump having a base and a reciprocable diaphragm, an actuator arm affixed to said diaphragm at a location between the two ends of said arm, pivot means for supporting one end of said arm, and electromagnet means operable to reciprocate the unsupported end of said arm and thereby cause said arm to pivot about said pivot means and effect reciprocating movement of said diaphragm, the alignment means comprising: an integrally-molded bracket which includes a first leg comprising said diaphragm pump base and means for removably securing it to the housing independently of electromagnet means, and a second leg which positions said pivot means effectively to support the actuator arm in spaced relation to said pump base such that reciprocation of said actuator arm will reciprocate said diaphragm.

12. An alignment means according to claim 11 which includes at least two means for restricting movement of said alignment means relative to said housing.

13. An alignment means according to claim 11 wherein said base of said diaphragm pump comprises a cylindrical wall enclosing a pumping chamber having an input flutter valve operable to permit air to enter but inhibit its exhaust through an input port, and an output flutter valve operable to permit air to exhaust but inhibit its entrance through an exhaust port, said cylindrical wall adapted to sealingly engage said diaphragm.

* * * * *

REEXAMINATION CERTIFICATE (1304th)

United States Patent [19] [11] B1 4,610,608

Grant [45] Certificate Issued Jun. 12, 1990

[54] AIR PUMP CONSTRUCTION

[75] Inventor: Benton H. Grant, Stamford, Conn.

[73] Assignee: Grant Airmass Corporation, Stamford, Conn.

Reexamination Request:
No. 90/001,717, Feb. 3, 1989

Reexamination Certificate for:

| | |
|---|---|
| Patent No.: | **4,610,608** |
| Issued: | **Sep. 9, 1986** |
| Appl. No.: | **412,287** |
| Filed: | **Aug. 27, 1982** |

[51] Int. Cl.[5] ..... F04B 45/04
[52] U.S. Cl. ..... 417/413
[58] Field of Search ..... 417/413, 416, 419, 472

[56] References Cited

U.S. PATENT DOCUMENTS

| | | |
|---|---|---|
| 2,518,504 | 8/1950 | Stott . |
| 2,808,622 | 10/1957 | Stott et al. . |
| 3,635,592 | 1/1972 | Kolfertz . |
| 3,669,573 | 10/1970 | Levensohn . |
| 3,671,151 | 6/1972 | Duke et al. . |
| 3,825,374 | 7/1974 | Kondo . |
| 4,154,559 | 5/1979 | Enomoto . |
| 4,162,876 | 7/1979 | Kolfertz . |
| 4,170,439 | 10/1979 | Hase . |

*Primary Examiner*—Peter M. Cuomo

[57] ABSTRACT

Disclosed is an electric air pump assembly and a subassembly for use therein which speeds assembly and assures proper alignment of the operative pump parts to facilitate proper pump operation while minimizing fatigue failures due to misalignment.

The electric air pump assembly (10) is of the type comprising a housing (20) enclosing at least one diaphragm pump (30) having a base (31) and a reciprocable diaphragm (32), an actuator arm (40) affixed to the diaphragm at a location between the two ends of the arm, pivot means (61) for supporting one end (43) of the arm, and electromagnet means (50) operable to reciprocate the unsupported end (41) of the arm and thereby cause the arm to reciprocate about the pivot means and effect reciprocating movement of the diaphragm which in turn creates an air flow from the pump. Alignment means (60) are provided for aligning the actuator arm and the diaphragm within the housing, the alignment means being attachable to the housing and being integral with both the diaphragm pump base and the pivot means.

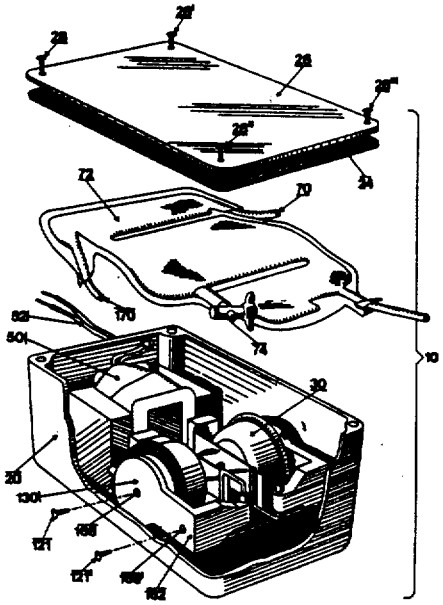

REEXAMINATION CERTIFICATE ISSUED UNDER 35 U.S.C. 307

THE PATENT IS HEREBY AMENDED AS INDICATED BELOW.

Matter enclosed in heavy brackets [ ] appeared in the patent, but has been deleted and is no longer a part of the patent; matter printed in italics indicates additions made to the patent.

AS A RESULT OF REEXAMINATION, IT HAS BEEN DETERMINED THAT:

Claims 1, 7, 11 and 13 are determined to be patentable as amended.

Claims 2–6, 8–10 and 12, dependent on an amended claim, are determined to be patentable.

1. An electric air pump assembly of the type comprising a housing containing at least one diaphragm pump having a base and a reciprocable diaphragm, an actuator arm affixed to said diaphragm at a location between the two ends of said arm, pivot means for supporting one end of said arm, and electromagnet means operable to reciprocate the unsupported end of said arm and thereby cause said arm to reciprocate about said pivot means and cause said diaphragm to reciprocate in a pumping action, which further comprises: alignment means, integrally formed in one piece with said diaphragm pump base, *a cylindrical wall forming a pumping chamber* and said pivot means, for aligning said actuator arm and said diaphragm within said housing, said alignment means being attachable to and removable from said housing independently of said electromagnet means.

7. An electric air pump assembly according to claim 1 wherein said diaphragm is rubber and sealingly engages the exterior of [a] *said* cylindrical wall comprised in said base of said diaphragm pump; said cylindrical wall enclosing [a] *said* pumping chamber having an input flutter valve operable to permit air to enter but inhibit its exhaust through an input port, and an output flutter valve to permit air to exhaust but inhibit its entrance through an exhaust port.

11. An alignment means adapted for use with an electric air pump assembly of the type comprising a housing containing at least one diaphragm pump having a base and a reciprocable diaphragm, an actuator arm affixed to said diaphragm at a location between the two ends of said arm, pivot means for supporting one end of said arm, and electromagnet means operable to reciprocate the unsupported end of said arm and thereby cause said arm to pivot about said pivot means and effect reciprocating movement of said diaphragm, the alignment means comprising: an integrally-molded bracket which includes a first leg comprising said diaphragm pump base, *a cylindrical wall forming a pumping chamber* and means for removably securing it to the housing independently of electromagnet means, and a second leg which positions said pivot means effectively to support the actuator arm in spaced relation to said pump base such that reciprocation of said actuator arm will reciprocate said diaphragm.

13. An alignment means according to claim 11 wherein said base of said diaphragm pump comprises [a] *said* cylindrical wall enclosing [a] *said* pumping chamber having an input flutter valve operable to permit air to enter but inhibit its exhaust through an input port, and an output flutter valve operable to permit air to exhaust but inhibit its entrance through an exhaust port, said cylindrical wall adapted to sealingly engage said diaphragm.

* * * * *